US005671585A

United States Patent [19]

Peronek et al.

[11] Patent Number: 5,671,585

[45] Date of Patent: Sep. 30, 1997

[54] QUICK CHANGE CONNECTION FOR FILLING AND CAPPING MACHINES

[75] Inventors: Michael H. Peronek, Strongsville; Daniel L. Goodell, Tallmadge, both of Ohio

[73] Assignee: FCI, Inc., Cleveland, Ohio

[21] Appl. No.: 645,555

[22] Filed: May 13, 1996

[51] Int. Cl.[6] ..... B65B 7/28; B65B 59/04

[52] U.S. Cl. ..... 53/253; 53/201; 53/282; 53/300

[58] Field of Search ..... 53/253, 249, 201, 53/283, 292, 272, 273, 471, 300

[56] References Cited

U.S. PATENT DOCUMENTS

| | | | |
|---|---|---|---|
| 2,987,313 | 6/1961 | Bjering et al. | 269/153 |
| 3,537,231 | 11/1970 | Dimond | 53/201 |
| 3,875,725 | 4/1975 | Carmichael | 53/300 X |
| 4,114,347 | 9/1978 | Morris et al. | 53/300 |
| 4,295,320 | 10/1981 | Willingham | 53/201 |
| 4,624,098 | 11/1986 | Trendel | 53/314 |
| 4,663,913 | 5/1987 | Trendel | 53/314 |
| 4,939,890 | 7/1990 | Peronek | 53/486 |
| 5,581,975 | 12/1996 | Trebbi et al. | 53/300 X |

*Primary Examiner*—James F. Coan
*Attorney, Agent, or Firm*—Vickers, Daniels & Young

[57] ABSTRACT

A quick connect clamp for a bottling machine is provided. The quick connect clamp includes a bayonnet clamp having a rod portion and a complementary rod grasping portion. The rod portion including a handle at one end for actuating the clamp and locking projections on the other end for inserting within the rod grasping portion, the rod portion including a spring mechanism for placing the clamp in tension in a locked position. The locking projections coact with a cam surface on the rod grasping portion to lock and unlock the clamp.

50 Claims, 13 Drawing Sheets

QUICK CHANGE CONNECTION FOR FILLING AND CAPPING MACHINES

The present invention is related generally to an apparatus for use in the bottling industry for filling or capping containers and more particularly to an improved connection for use in filling or capping machines which allows quick change of parts of the machine to allow different size bottles to be run on the same machine.

The invention is particularly applicable to a clamp rod which is used in place of standard fasteners to attach different parts to the bottling machine and will be described with particular reference thereto.

BACKGROUND OF THE INVENTION

Machines in the bottling industry for filling containers or capping containers after being filled are well known in the prior art. As defined herein, such machines are collectively referred to as bottling machines. Reference may be had to U.S. Pat. Nos. 4,939,890; 4,624,098; and 4,295,320; incorporated by reference herein, for a description of applications for conventional type capping machines. For purposes herein, capping and bottling machines have generally the same characteristics. Such machines will not be described in detail in this specification.

Generally, a capping or filling apparatus includes a rotatable star wheel mechanism for moving the bottles or containers through the machine. A star wheel, as defined herein, refers to the rotatable wheel used to convey bottles through both filling and capping machines. The star wheel also generally includes a mechanism for supporting the container which can either be removable neck support assemblies or pockets within the star wheel hub that are arranged about the periphery of the star wheel. An in-feed conveyor or other mechanism is utilized to bring bottles to an entry point of the star wheel and an out-feed conveyor or other mechanism is similarly mated to the rotatable star wheel mechanism to transfer the capped (or filled) bottle from an exit point of the star wheel. A stationary rear guide extending generally between the entry and exit point of the star wheel is spaced radially outwardly from the neck support assembly on the rotatable star wheel. This rear guide functions to retain the bottles in the individual pockets of the neck support assembly as the star wheel rotates. In a bottle filling apparatus, a filling head is located over the star wheel. In a capping apparatus, a capper head is directly over the capper star wheel and moves in synchronis rotation with the capper star wheel. Either the capper head or the filling head is driven downward at predetermined periods of time to place the product within the bottle or to place the tightened cap onto the bottle neck.

A typical bottling plant or facility utilizes a single capping or filling machine to fill or cap many different size bottles. For instance, in the soft drink industry, such size bottles can include a 12 ounce, a 20 ounce, a 1 liter bottle, or others. Positive control of the bottles throughout the machine is typically maintained by holding the bottles by the neck. Thus, based upon a predetermined control height, all bottles will be suspended throughout the filling or capping process by the bottle neck ring. The control height is determined by the tallest bottle to be filled. This height is then maintained constant for all other size bottles to be run in the same machine. Normally, the bottle will be suspended ¼-inch above the normal wear surface. Mounted on the basic shaft of the bottling machine is a hub which supports the star wheel thereon. As the shaft is rotated, the hub rotates the star wheel, thus moving bottles through the machine to accomplish the capping and filling process. Smaller star wheels include neck support assemblies integral with the hub. Larger star wheel assemblies include neck guide assemblies mounted on the star wheel. Each neck guide assembly has fingers extending therefrom and supports the neck of the bottle. In order to retain the control height constant for different size bottles, each bottle requires a different size and/or shape neck support bracket. Thus, in each instance where the bottle sizes to be run is changed, it is necessary to change certain parts of the bottling machine including those parts of the machine which are specific to the particular bottle size being run on the line.

In a bottling plant, a changeover of parts generally requires the use of skilled labor to remove the equipment which is specific for a particular size bottle and replace it with substitute equipment which is specific for a different size bottle. When it is realized that thousands of bottles pass through a bottling machine each hour, it becomes obvious that there is a significant loss in both dollars and productivity during any changeover of equipment. It is thus important to reduce any downtime to a minimum. Reducing such downtime is advantageous in maintaining the large volume of product produced by a bottling plant to meet both consumer and industry demands as well as plant capacity. Reducing downtime also reduces dollar losses as well as productivity due to reduced output capacity and reduces idle manpower. A skilled workforce is also required to complete a changeover of parts. The use of common fasteners such as bolts to attach the interchangeable aspects of the bottling machine increases the time required to complete a changeover and also adds to the number of spare parts which must be inventoried and readily available should others become lost or broken. Care must also be taken during changeover to ensure that all bolts are fastened tightly. Failure to do so may result in bolts coming loose and causing damage to a machine or shutting down an entire line within a bottling plant.

As discussed above, star wheel assemblies typically come in two different arrangements. Smaller star wheels include neck support assemblies integral with the hub, while larger star wheel assemblies include neck guide assemblies mounted on the star wheel. In each instance where the bottle size to be run is changed, either the star wheel must be removed and replaced from the hub of the bottling machine or the individual neck support assemblies on the larger star wheel must be individually removed and replaced with a different size neck support assembly. Removing and replacing the star wheel or the neck support assemblies allows that the control height may be increased or decreased depending upon the new bottle size to be run. For smaller star wheels having neck support assemblies integral therewith, the entire star wheel is replaced with a substitute star wheel of a different size to facilitate the changeover. A changeover for a large star wheel can happen one of two ways.

Individual neck support assemblies can be removed from a large star wheel and replaced with different individual neck support assemblies of a different size to facilitate running a different size bottle. However, larger star wheel assemblies typically have 19 neck support sections. Each one of these is individually bolted onto the star wheel at four or five locations. Each one of the bolts pass through the neck support and are threaded into the star wheel. These threaded connections typically require a torque wrench or other tool for tightening. In an effort to reduce the time required for changeover, different star wheel assemblies can be preassembled with different neck support assemblies for each size bottle. At the time of the changeover, the entire star wheel is removed and replaced with a different preassembled star wheel. However, the removal of these star wheels is also problematic. The weight of the hubs requires that they be assembled in two halves. Thus, two people are generally required to lift and install. Additionally, as in capping or filling machines, clearance below the capper head makes installation especially difficult. Finally, after installation, fine-tune adjusting and retiming is required to ensure that the neck support assemblies on the replaced star wheel coincide and are synchronis with in-feed and outlet conveyor systems as well as the capper head in the case of a capping machine or a filling head in the case of a filling machine. Care must also be taken during changeover to ensure that all bolts are fastened tightly. Failure to do so may result in bolts coming loose and causing damage to a machine or shutting down and entire bottling line within a facility. The vibrations associated with the running of the bottling line typically result in at least some of the bolts coming loose. When such event occurs, the entire line must be shut down until the problem is fixed.

SUMMARY OF THE INVENTION

The present invention advantageously provides an improved clamp connection for a bottling machine which overcomes the disadvantages of prior art connection arrangements. In this respect, a quick connect clamp has been designed for quick installation and removal of replacement parts on a bottling machine. The quick connect clamp allows the machine operator to flip a handle and remove a specific size part and replace it with a second part which is identical except in size. After initial installation, the quick connect clamp need only be inserted in the part at the location to be installed and turned 90° to lock the part into place. The bayonnet clamp assembly (or quick connect clamp rod) of the invention is particularly advantageous in that it is used to replace threaded bolts used in prior art systems. The quick connect clamp rod is designed so that parts may be replaced without the use of tools. This advantageously reduces downtime associated with the changeover, and reduces idle manpower since the machine operator is capable of making the changeover. This provides positive mounting to the bottling machine with an installation time far less than required for bolted connections. Once initial modifications are made to facilitate the invention, no further modifications are necessary to run different bottle sizes.

More particularly in this respect, a quick connect clamp for a conventional bottling machine for filling or capping containers is provided. The bayonnet clamp includes a rod portion and a complementary rod grasping portion which is installed on the machine. The rod portion includes a handle on a first end for actuating the clamp and locking projections on a second end for inserting within the rod grasping portion. The rod portion includes a biasing mechanism for actuating the locking projection, which preferably includes a compression surface opposite the handle and a spring mechanism therebetween for axially moving the compression surface between a first position and a second position. The rod grasping portion includes a cam design which coacts with the locking projection to draw down the rod portion. The cam mechanism is located on an end of the rod grasping portion and specifically includes a helical surface to coact with the locking projections.

In an initial installation, the rod grasping portion is placed in the threaded holes within which a bolt would normally be placed. For this purpose, the rod grasping portion can be provided with a threaded stud or alternatively spot welded in place. If necessary, a hole may be tapped or bored at an appropriate place within the bottling machine in order to install the rod grasping portion. The mating holes of replacement parts, with the clamp rod assembled therein, can then be placed over, and in substantial registry with, the rod grasping portion. The clamp rod is then inserted into the rod grasping portion. The locking projections extend within the rod grasping portion and with a quick 90° turn of the clamp rod, are drawn down by the cam surface of the rod grasping portion. The biasing mechanism, particularly the compression surface coacting with the spring mechanism collapses due to the cam action of the helical surface, thereby making a tension connection and positively retaining the clamp rod into position. In order that the locking projections do not slide back along the helical surface, a preferred embodiment contemplates two semi-cylindrical concave slots located at the lower end of the helical surface to capture the locking projections. In order to disengage the locking projections from the semi-cylindrical slots, a clamp rod need only be pushed along its axis toward the rod grasping portion and turned 90° along the helical surface, whereby the clamp rod may be removed from position.

In a preferred embodiment, the clamp rod includes a mechanism for adjusting the compression applied to the biasing mechanism. The mechanism for adjusting can include a lock nut positioned against the biasing mechanism or two nuts coacting against each other in order to lock both in position at a specified position along the rod. Once this initial adjustment is performed, it is contemplated that no further adjustments are necessary. It is further contemplated that the rod grasping portion is preferably a cylindrical piece or plug having a slotted opening with a circular center portion to accept the rod and allow the locking projections to pass therethrough. The semi-cylindrical concave slots located at the ends of the helical surface are spaced 90° from the slots within the opening of the rod grasping portion.

In a specific embodiment, the bayonnet clamp rod is particularly applicable to a bottling machine for filling or capping containers having a generally circular cross-section, the bottling machine comprising a rotatable star wheel having a plurality of peripheral, individual neck support assemblies for receiving and moving the containers through the machine. Each of the plurality of individual neck support assemblies includes a pocket support for holding the containers and a star wheel support portion attached to the star wheel. The star wheel support portion is attached to the pocket support portion by the bayonnet clamp including a rod portion extending through the pocket support and a complementary rod grasping portion on the star wheel support portion. The rod support portion includes a handle on a first end for actuating the clamp, locking projections on the second end for inserting within the rod grasping portion and a biasing mechanism for actuating the locking projections.

In another embodiment, the invention comprises a bottling machine for filling or capping containers having a generally circular cross-section comprising a rotatable star wheel mounted on the hub of the bottling machine for moving the containers through the machine. The star wheel for supporting the containers includes pocket supports for holding and supporting the containers therein. A rear guide is located radially outwardly from the star wheel for retaining the containers within the pocket support during rotation of the star wheel. The rear guide includes a sidewall guide for maintaining the sidewalls of the containers in position during rotation of the star wheel. The star wheel is mounted to the hub by the bayonnet clamp rod, having a rod portion extending through the star wheel and a complementary rod grasping portion on the hub. The rod portion includes a handle on a first end for actuating the clamp, locking projections on a second end for inserting and releasably retaining within the rod grasping portion and biasing means for actuating the locking projections.

In a further embodiment, the invention also includes a bottling machine for filling or capping containers having a generally circular cross-section comprising a rotatable star wheel mounted on the hub of the bottling machine for moving the containers through the machine. The star wheel includes pocket supports for holding and supporting the containers therein. A rear guide is located radially outwardly from the star wheel for retaining the container within the pocket support during rotation of the star wheel. The rear guide includes a sidewall guide for maintaining the sidewalls of containers in position during rotation of the star wheel. The star wheel includes a first semi-circular half and a second semi-circular half, each of the halves mounted to the hub of the machine by bayounet clamp rods having a rod portion extending through each of the first halves and a complementary rod grasping portion on the second semi-circular half, the rod portion including a handle on a first end for actuating the clamp, locking projections on the second end for inserting and releasably retaining within the rod grasping portion and a biasing mechanism for actuating the locking projections.

It is thus, an outstanding object of the present invention to provide an improved fastener connection for a bottling machine to facilitate the removal and replacement of parts.

It is yet another object of the present invention to provide an improved fastener connection for a bottling machine which does not require tools for installation or removal.

Still another object of the present invention is to provide an improved bottling machine which facilitates easy installation and removal of a star wheel thereon without the use of tools.

Yet another object of the present invention is to provide an improved bottling machine which reduces the idle time required for a changeover and replacement of equipment and parts.

Yet still another object of the present invention is to provide an improved bottling machine which eliminates the need for adjusting and retiming of the bottling line after equipment and part changeover.

Still another object of the present invention is to provide an improved method of changing over a bottling line to accommodate different size bottles.

It is still another object of the present invention to provide an improved bottling machine with neck support brackets which have been designed that allow the operator to flip a handle and remove the neck support in a matter of seconds with no tools.

It is yet another object of the present invention to reduce the costs associated with the changeover of equipment and parts in the bottling industry.

These and other objects of the invention will become apparent to those skilled in the art upon reading and understanding the following detailed description of the preferred embodiments.

BRIEF DESCRIPTION OF THE DRAWINGS

The invention will take physical form in different parts and arrangement of parts, the preferred embodiment of which will be described in detail and illustrated in the accompanying drawings to form a part hereof and wherein.

DESCRIPTION OF THE PREFERRED EMBODIMENTS

Figure 1:
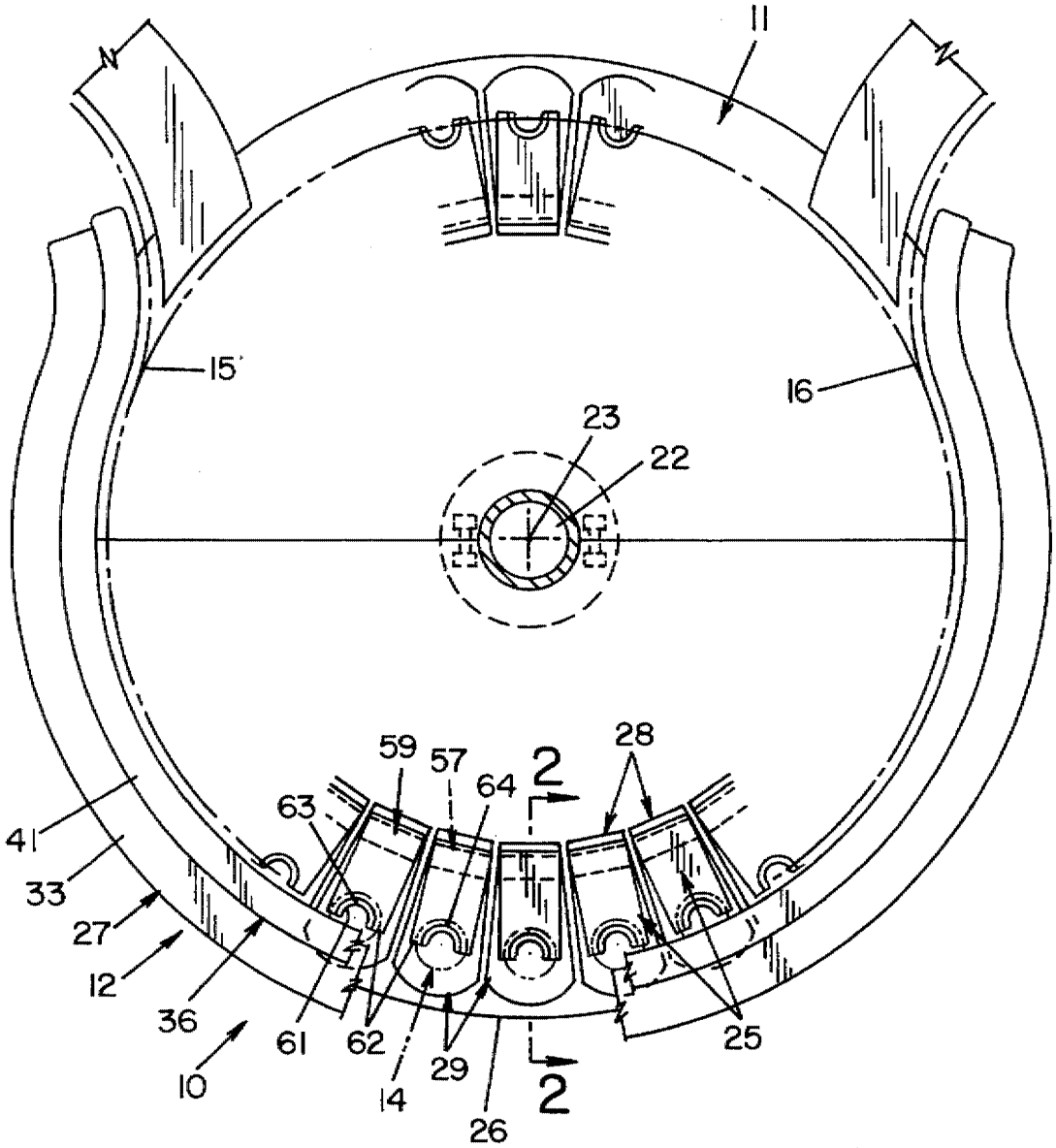
FIG. 1 is a plan view of a bottling machine employing the clamp rod of the present invention.
Figure 2:
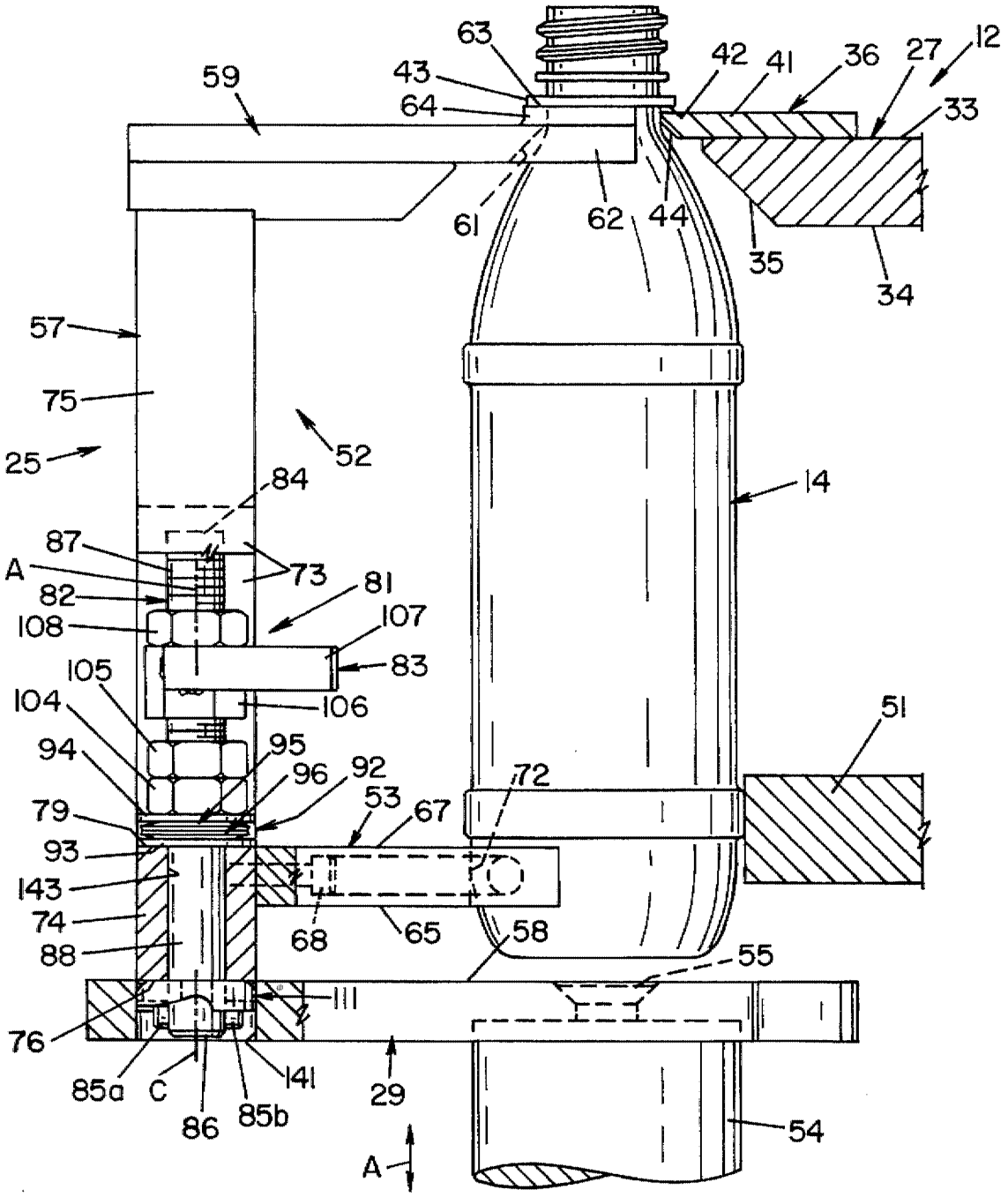
FIG. 2 is a cross-sectional elevation view taken along line 2—2 of FIG. 1.
Figure 3:
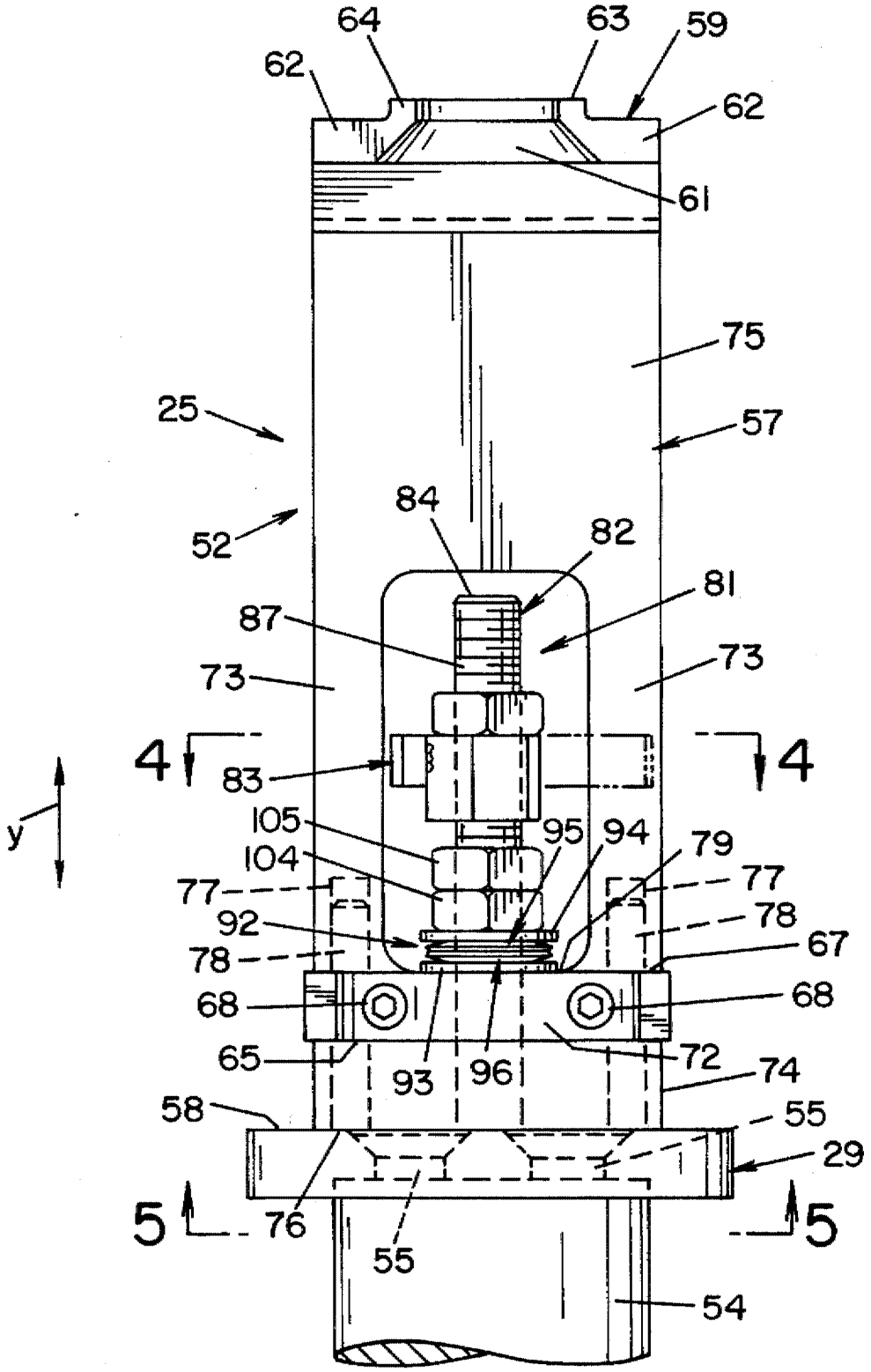
FIG. 3 is an elevation view of a neck support assembly employing the present invention.

Referring now to the drawings wherein the showings are for the purpose of illustrating the preferred embodiments of the invention only and not for the purpose of limiting same, FIGS. 1 and 2 show various portions of what is defined as a bottling machine 10. As noted in the background portion of this specification, bottling machine as defined herein includes both filling and capping bottling equipment; filling equipment being that which fills containers with product, such as soft drink, and capping equipment being that which applies a cap, crown, or other closure to the container.

Bottling machine 10 includes a rotatable star wheel 11 and a rear container guide 12 spaced radially outwardly from rotatable star wheel 11 for retaining the bottles 14 within the rotatable star wheel 11. As also defined herein, rotatable star wheel refers to the rotatable wheel used to convey bottles through both filling and capping machines. Depending upon the application of bottling machine 10, an additional star wheel (not shown) or conveyor (not shown) is mated to rotatable star wheel 11 at a fixed entry point 15 on rotatable star wheel 11. Bottles 14 are rotated out of rotatable star wheel 11 at a fixed exit point 16 to an out-feed star wheel or conveyor (not shown) leading to further processing or handling equipment. Rotatable star wheel 11 is attached to a drive shaft 22 which rotates upon a drive shaft axis 23.

In the first embodiment shown in FIGS. 1–10, a plurality of neck support assemblies 25 extend radially outwardly from drive shaft 22. This particular embodiment, and the neck support assemblies 25 thereon, is specifically applicable to bottle filling machines. As shown, each of neck support assemblies 25 is mounted on star wheel 11 at a neck support station 28. Each of neck support assemblies 25 is arranged about the periphery 26 of rotatable wheel 11, which is generally circular. Each neck support assembly 25 is supported on a bottom ledge plate 29 which is attached to the periphery 26 of rotatable wheel 11. Each neck support assembly 25 is removable from rotatable wheel 11 as will be described hereafter, though other embodiments, known in the industry, are available.

The rear container guide 12 includes an annular rear neck guide 27 secured in a stationary manner to a frame member (not shown). Rear neck guide 27 has a top surface 33, a bottom surface 34, and an inclined edge surface 35 which extends radially outwardly from top surface 33 to bottom surface 34. An annular neck block 36 is secured to top surface 33 of rear neck guide 27. Neck block 36 has atop surface 41 which, as shown in FIG. 2, is adapted to be in contact with the underside 42 of a flange 43 of bottle 14. Neck block 36 also includes an inclined edge surface 44 extending radially outwardly from top surface 41. Rear container guide 12 and specifically annular neck block 36 function to support flange 43 and bottle 14 by retaining bottle 14 on rotatable wheel 11. The details of rear container guide 12 can generally be found in the prior art. An annular sidewall rear guide 51 is also part of rear container guide 12. Sidewall rear guide 51 is adjustable (not shown) in order that it may be placed in optimum position to contact the sidewall of bottle 14. Sidewall rear guide 51 functions to maintain bottles 14 in position while rotatable wheel 11 rotates bottles 14 from entry point 15 to exit point 16.

Specifically, as shown in FIG. 2, neck support assembly 25 is for a bottle filling machine. Neck support assembly 25 on a bottle filling machine is generally comprised of three distinct pieces including the aforementioned bottom ledge plate 29, a neck guide 52, and a bottom body guide 53. Each of neck support assemblies 25 is attached to the periphery 26 of rotatable wheel 11 by individual bottom ledge plates 29. A typical filling machine may include anywhere between 45 and 95 individual bottom ledge plates 29. Typically, dependent upon the diameter of rotatable wheel 11, there are either 45, 72 or 95 individual bottom ledge plates 29 for a filling machine. In conjunction therewith, each individual bottom ledge plate 29 is connected to a lift cylinder rod 54 by the fasteners 55. At the appropriate time, each of lift cylinder rods 54 actuate to lift bottom ledge plate 29 and thus neck support assembly 25 connected thereto in a vertical direction as defined by arrow A in FIG. 2 in order that the mouth of bottle 14 is inserted over a filling head (not shown) on the filling machine. Product is dispensed into bottle 14 and, when completed, lift cylinder rod 54 is again actuated to lower bottom ledge plate 29 along a vertical axis as defined again by arrow A, thus removing the mouth of bottle 14 from the filling head. Rotatable wheel 11 then causes bottle 14 to be rotated out of the filling machine and on to further processing or handling equipment within the bottling line.

In order that bottle 14 is adequately supported during the lifting and lowering operations, neck support assembly 25, and specifically neck guide 52 includes a vertical standard 57 extending upwardly from the top surface 58 of bottom ledge plate 29. A guide bracket 59, extending perpendicular from vertical standard 57 and radially outwardly therefrom ends at a retaining pocket 61 formed by the opposite extending fingers 62 extending from guide bracket portion 59. Each retaining pocket 61 is generally semi-circular in configuration and encompasses an included angle of approximately 180° between adjacent fingers 62. Bottle neck flange 43 rests on a top surface 63 of a railed portion 64 of guide bracket 59. This is at an area diametrically opposed to contact established by neck block top surface 41 which coacts and functions to maintain bottle 14 within retaining pocket 61 as rotatable wheel 11 rotates.

As shown in FIG. 2, bottom body guide 53 includes a body guide bottom surface 65 and a body guide upper surface 67. Bottom body guide 53 is rigidly attached to neck guide 52 by the hex head screws 68. Each bottom body guide 53 includes a retaining pocket 72 similar in cross-section, but larger than retaining pocket 61. As such, bottom body guide 53 contacts the sidewall of bottle 14 at an area vertically downward from retaining pocket 61 and at an area diametrically opposed to a sidewall contact established by annular sidewall rear guide 51 to retain bottle 14 substantially vertical while rotatable wheel 11 rotates bottles 14 from a fixed entry point 15 to fixed exit point 16.

As best seen in FIGS. 2–5, vertical standard 57 includes two vertical post portions 73 extending from an upper side 79 of bottom block portion 74, which is attached to bottom ledge plate 29. Extending upwardly from vertical post portions 73 is upper block portion 75 which is attached to guide bracket 59. Extending upwardly from a lower side 76 of vertical standard 57 and specifically through bottom block portion 74 are two vertical bores 77. Extending from the top surface 58 of bottom ledge plate 29 are the two dowel pins 78 which are inserted within vertical bores 77 to provide proper alignment of each neck support assembly 25 on each bottom ledge plate 29.

Prior art teaches that neck support assemblies 25 are attached to bottom ledge plate 29 using threaded bolts. As can easily be seen, removing and replacing anywhere between 45 and 95 neck support assemblies per each filling machine significantly adds to the mount of downtime required to change parts when it is desired to run a different size bottle on the bottling line. The present invention overcomes these disadvantages by providing a quick connect clamp 81 which includes a rod portion 82 and a handle portion 83 located generally adjacent a first end 84 of rod portion 82. The two locking projections **85*a* and 85*b* are located adjacent a second end 86 of rod portion 82. It will be appreciated that rod portion 82 is a cylindrical dowel located on an axis A while locking projections 85*a* and 85*b* are cylindrical and located on a common axis B, which axis B is perpendicular to axis A. As can best be seen in FIGS. 7, 8A and 8B, locking projections 85*a* and 85*b* extend from opposite sides of rod portion 82. Rod portion 82 also includes a threaded portion 87 extending from first end 84 and a non-threaded portion 88 extending from second end 86, locking projections 85*a* and 85*b* extending from non-threaded portion 88**.

Located adjacent, a mid-point area 91 of rod portion 82 in which threaded portion 87 ends and non-threaded portion 88 begins, is located a biasing mechanism 92 of quick connect clamp 81. The biasing mechanism 92 includes a washer 93 which serves as a compression surface, a washer 94 and two Belleville spring washers 95 and 96 located between washers 93 and 94. As is well known in the prior art, Belleville spring washers are of a frusto-conical shape and include an inner diameter 101 and an outer diameter 102 with an inclined edge surface 103 extending therebetween. As Belleville spring washers are compressed by axial forces applied at either of the inner or outer diameters, inclined edge 103 tends to flatten into a plane which generally approaches a plane generally parallel to that occupied by either inner diameter 101 or outer diameter 102. In the preferred embodiment, spring washers 95 and 96 have inner diameters 101 abutting washers 93 and 94, while outer diameters 102 of each of the spring washers 95 and 96 are adjacent and abutting. This orientation is preferred since it is less likely particulate matter will get caught between adjacent spring washers 95 and 96, which particulates could prevent the collapsing action of the spring washers.

As shown in the embodiment of FIGS. 2–10, adjacent washer 94 are two hex nuts 104 and 105 which have been threaded on threaded portion 87 of rod portion 82. As shown, hex nut 104 is threaded just adjacent and in slight contact with washer 94. Hex nut 105 is then tightened into engagement with hex nut 104 whereby individual rotation of either of hex nuts 104 and 105 is prevented. It will be appreciated that hex nuts 104 and 105 are the mechanism by which the compression applied to spring washers 95 and 96 is adjusted. Once nuts 104 and 105 are in proper position for a specific application, no further adjustment is contemplated. It will also be appreciated that the adjustment performed by nuts 104 and 105 may also be provided by a single nylon lock nut (which, as well known in the art, generally includes a nylon inner diameter). Such a lock nut will generally not move by vibration or other non-intentional means from the position in which it is initially placed. Such a lock nut is also disclosed in other embodiments of the present invention which will desoribed later in the specification period.

Figure 4:
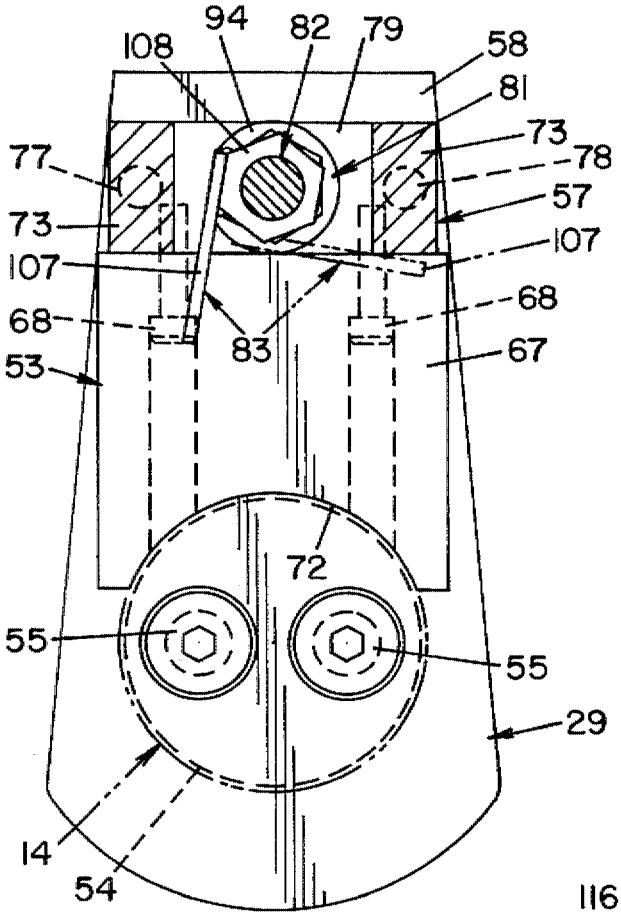
FIG. 4 is a cross-sectional plan view taken along line 4—4 of FIG. 3.
Figure 5:
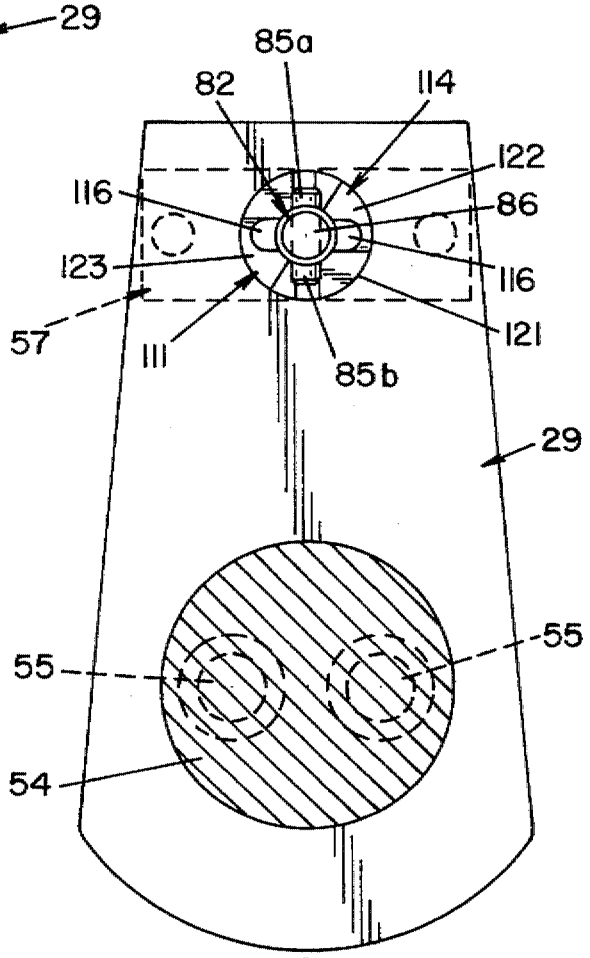
FIG. 5 is a cross-sectional bottom plan view taken along line 5—5 of FIG. 3.

As shown, handle 83 is comprised of a standard hex nut 106 having a clamp handle 107 welded thereto. A separate hex nut 108 is tightened against hex nut 106 to effectively lock handle portion 83 in a fixed position on rod 82. It will thus be appreciated that when handle portion 83 is turned approximately 90° (as shown in FIG. 4 in phantom) the interaction of hex nut 106 and hex nut 108 causes rod portion 82 to rotate in a like manner.

Quick connect clamp 81 includes a rod grasping portion 111 which, as shown in its preferred embodiment, is circular in shape. Rod grasping portion 111 coacts with rod portion 82 and specifically with locking projections 85*a* and 85*b* to make quick connect clamp 81 and lock rod portion 82 in place. The rod grasping portion 111 includes an upper surface 112 and an opposite lower cam portion 114. A central axis C extends between upper surface 112 and lower cam portion 114 and is generally perpendicular thereto. Rod grasping portion 111 includes a slotted opening 115 being coaxial with central axis C which includes slotted portions 116 extending from a central cylinder shape portion 117. Slotted potions 116 of slotted opening 115 lie on a common slotted axis D which is transverse to central axis C. Common slotted axis D intersects central axis C. Lower cam portion 114 is thus ring-shaped and extends between an outer cylindrical surface 121 and slotted opening 115 of rod grasping portion 111.

This generally ring-shaped lower cam portion 114 is comprised of a number of different surfaces. Included thereon are the ramp surfaces 122 and 123 and the lower planar surfaces 124 and 125 which are generally parallel with upper surface 112. Perpendicular to common slotted axis D and passing through central axis C is a lock axis L having the two semi-cylindrical concave slots 126 and 127, coaxial thereon. Each of common slotted axis D and lock axis L are perpendicular but are located in generally parallel planes. These axes divides lower earn portion 114 into four quadrants which are labeled I, II, III, and IV on FIGS. 8A and 8B. Ramp surfaces 122 and 123 are located in quadrants I and III, while lower planar surfaces 124 and 125 are located in quadrants II and IV, respectively. Ramp surfaces 122 and 123 are generally helical in shape and, beginning at common slotted axis D, slope downwardly and away from upper surface 112 to lock axis L and semi-cylindrical concave slots 126 or 127, respectively. It will be appreciated that portion of ramp surface 122 or 123 adjacent semi-cylindrical concave slot 126 or 127 is generally coplanar with lower planar surface 124 or lower planar surface 125, respectively.

Figure 6:
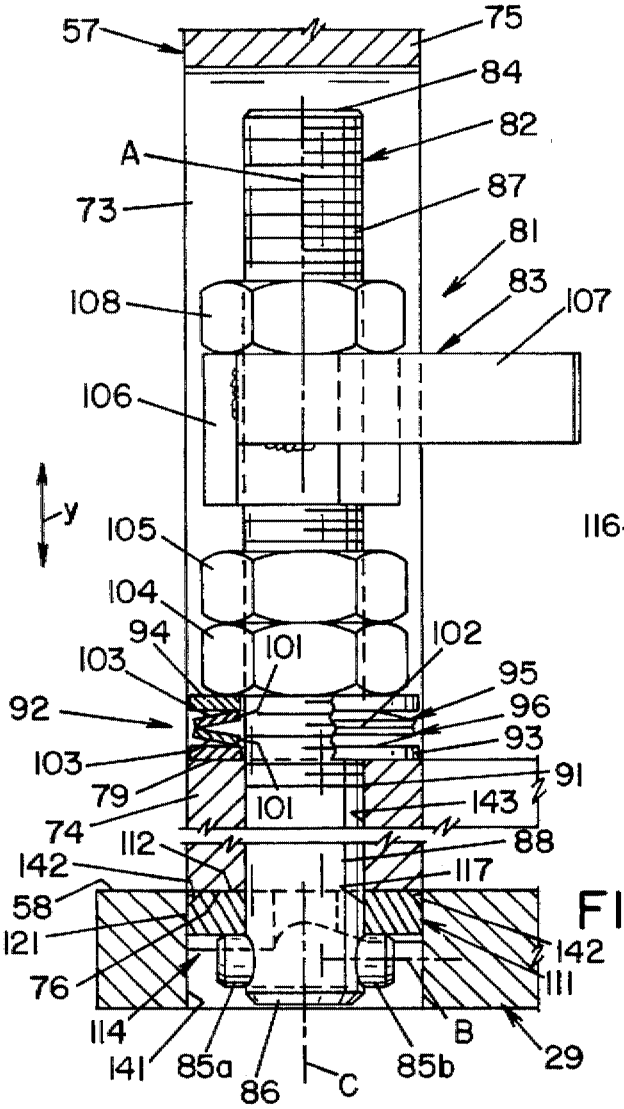
FIG. 6 is a cross-sectional elevation view taken from the side of FIG. 3.
Figure 7:
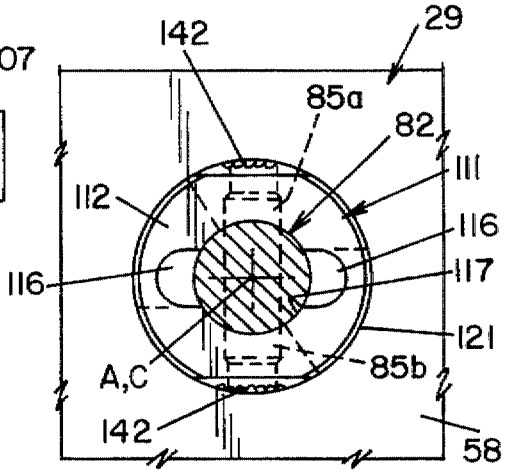
FIG. 7 is a cross-sectional plan view showing a particular feature of the present invention in a locked position.
Figure 8A:
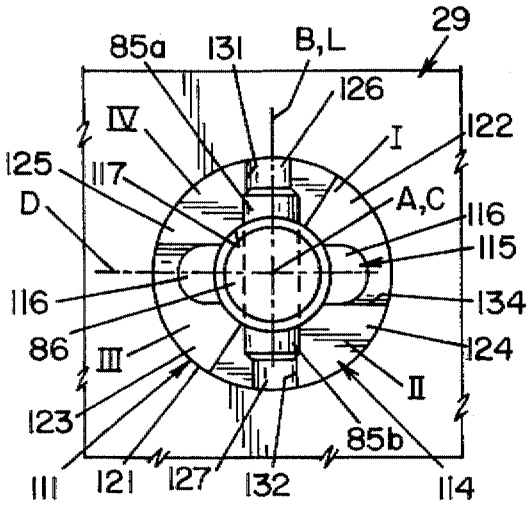
FIG. 8A is a bottom plan view showing a particular feature of the present invention in a locked position.
Figure 8B:
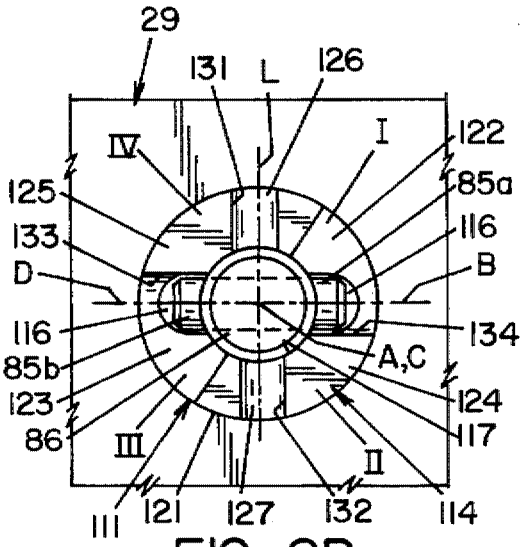
FIG. 8B is a bottom plan view showing a particular feature of the present invention in an unlocked position.
Figure 9:
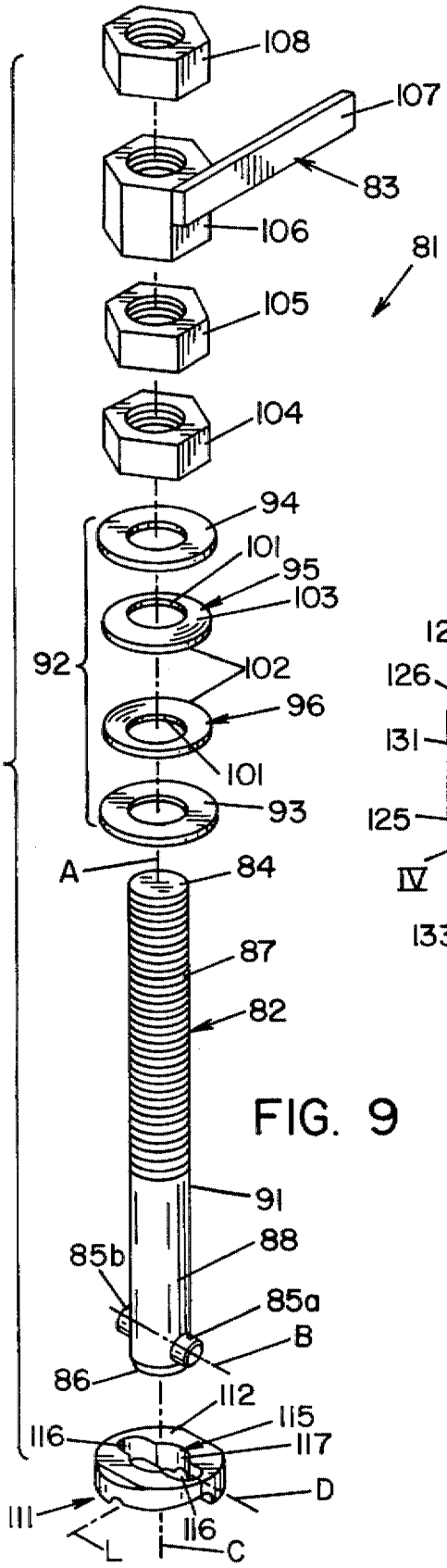
FIGS. 9 and 10 are exploded views showing the particular elements of one embodiment of the present invention.
Figure 10:
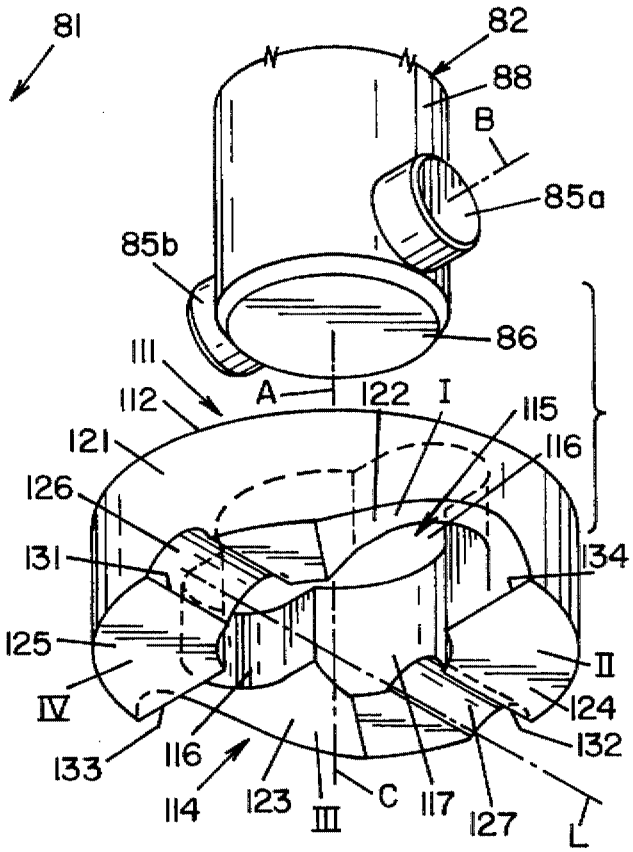
Figure 11:
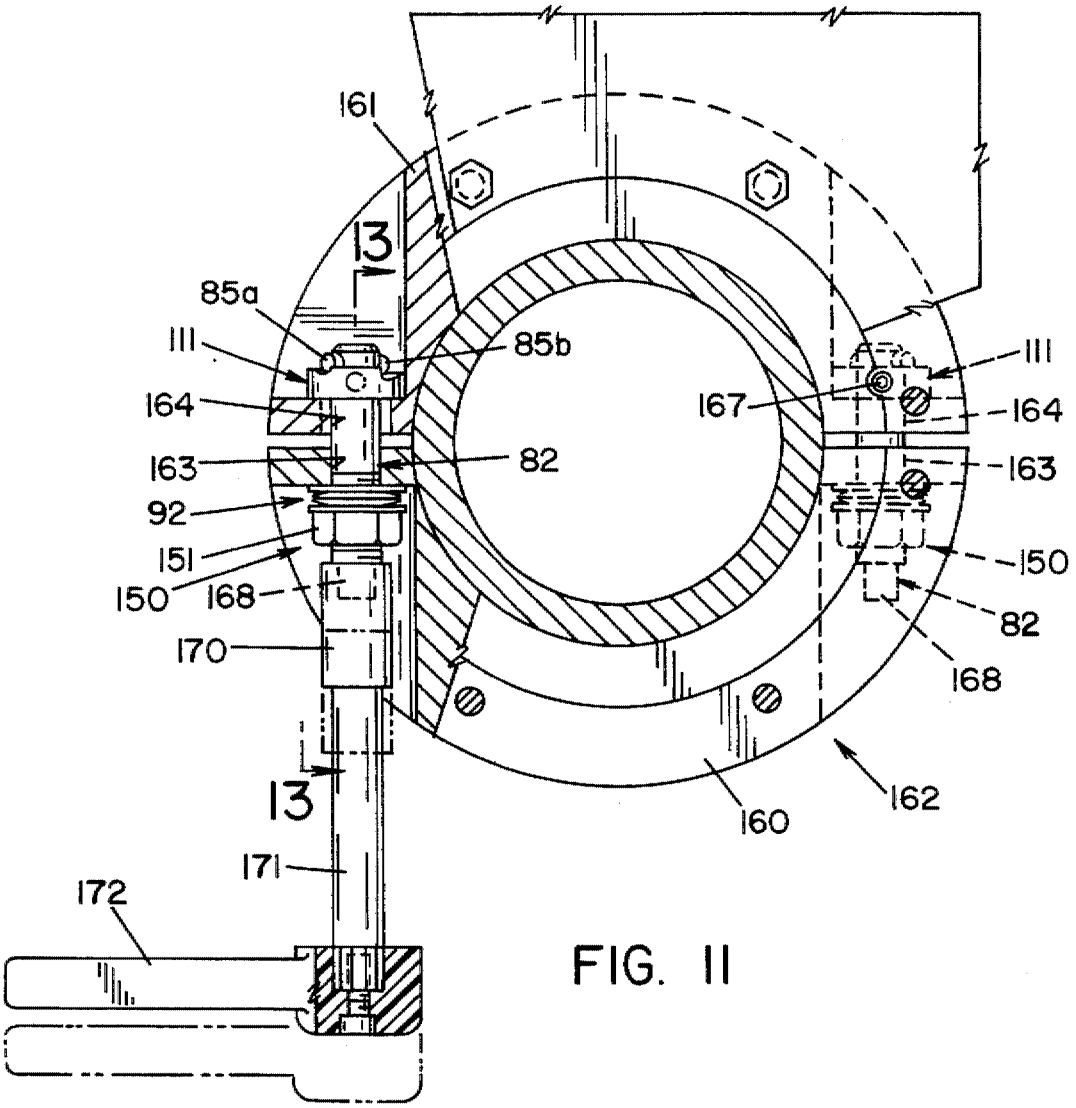
FIG. 11 is a plan view, partially in cross-section showing a second embodiment of the present invention.

It will also be appreciated that locking projections 85*a* and 85*b* have a diameter which is generally equal to or slightly less than the width of slotted portions 116 of slotted opening 115. It will further be appreciated that the diameter of locking projections 85*a* and 85*b* is generally equal to or slightly less than the diameter of semi-cylindrical concave slots 126 and 127. Thus, non-threaded portion 88 of quick connect clamp 81 can be inserted within slotted opening 115 such that locking projections 85*a* and 85*b* extend axially below lower cam portion 114 of rod grasping portion 111. Such initial insertion is shown in FIGS. 6 and 8B. Counterclockwise turning of rod portion 82 via handle portion 83 causes locking projections 85*a* and 85*b* to engage the helical ramp surfaces 122 and 123, respectively. Counterclockwise turning of rod portion 82, as shown in FIG. 8*a* and 8*b*, causes locking projections 85*a* and 85*b* to axially draw downward rod portion 82 in the y-direction, shown in FIG. 6. After 90° of mining, locking projections 85*a* and 85*b* fall into semi-cylindrical concave slots 126 and 127, respectively. Further mining of rod portion 82 is prevented by each of the wedge surfaces 131 and 132. Wedge surface 13 1 extends between semi-cylindrical concave slot 126 and lower planar surface 125, while wedge surface 132 extends between semi-cylindrical concave slot 127 and lower planar surface 124. Initial turning of rod portion 82 in a clockwise direction is prevented by wedge surfaces 133 and 134, with each of wedge surfaces 131 and 133 defining edges of lower planar surface 125, while wedge surfaces 132 and 134 define edges of lower planar surface 124.

Initial installation of quick connect clamp 81 is made by boring a hole 141 through bottom ledge plate 29. The diameter of bored hole 141 is substantially equal to or slightly greater than the outer diameter of rod grasping portion 111 as defined by outer cylindrical surface 121. As shown in FIG. 6, rod grasping portion 111 is placed within bored hole 141 and spot welded at the spotweld points 142 along the periphery of upper surface 112, thus forming a smooth surface flush with top surface 58 of ledge plate 29. The bottom block portion 74 of each of neck support assemblies 25 is also provided with a hole 142 bored therethrough between upper side 79 and lower side 76. This hole has a diameter slightly greater than the diameter of rod portion 82. Thus, rod portion 82 is first passed through hole 142 from lower side 76 to upper side 79 whereupon biasing mechanism 92 and specifically washers 93, 94 Belleville spring washers 95, 96, hex nuts 104, 105, hex nut 106 with clamp handle 107 and hex nut 108 are placed on threaded portion 87. Biasing mechanism 92 is adjusted by placing locking projections 85*a* and 85*b* within rod grasping portion 111 so that they extend just below ramp surfaces 122 and 123. Hex nut 104 is then screwed downwardly in the y-direction along axis A until it loosely engages washer 94 so that when washer 93 is in engagement with upper side 79, spring washers 95 and 96 remain in an unbiased, non-collapsed state. Hex nut 105 is thereupon tightened onto hex nut 104 to lock hex nut 104 into position. Hex nut 106 is placed somewhere between vertical post portions 73 and hex nut 108 is tightened thereon in order that turning of clamp handle 107 causes the entirety of rod portion 82 to also min. It will thus be appreciated that the mining of clamp handle 107 causes locking projections 85*a* and 85*b* to engage ramp surfaces 122 and 123 also causes spring washers 95 and 96 to collapse upon themselves between washers 93 and 94. As shown in FIG. 8A, once locking projections 85*a* and 85*b* engage with concave slots 126 and 127, tension has been placed on rod portion 82 and a tight connection achieved between neck assembly 25 and bottom ledge plate 29. The biased position of spring washers 95 and 96 ensures that this tension connection remains fast until clamp handle 107 is again engaged to cause rod portion 82 to rotate in a clockwise manner to disengage rod portion 82 from rod grasping portion 111. Quick connect clamp 81 thus provides a very efficient way to change parts, specifically neck support assemblies 25 in a manner which reduces the downtime previously associated with a part changeover.

Figure 12:
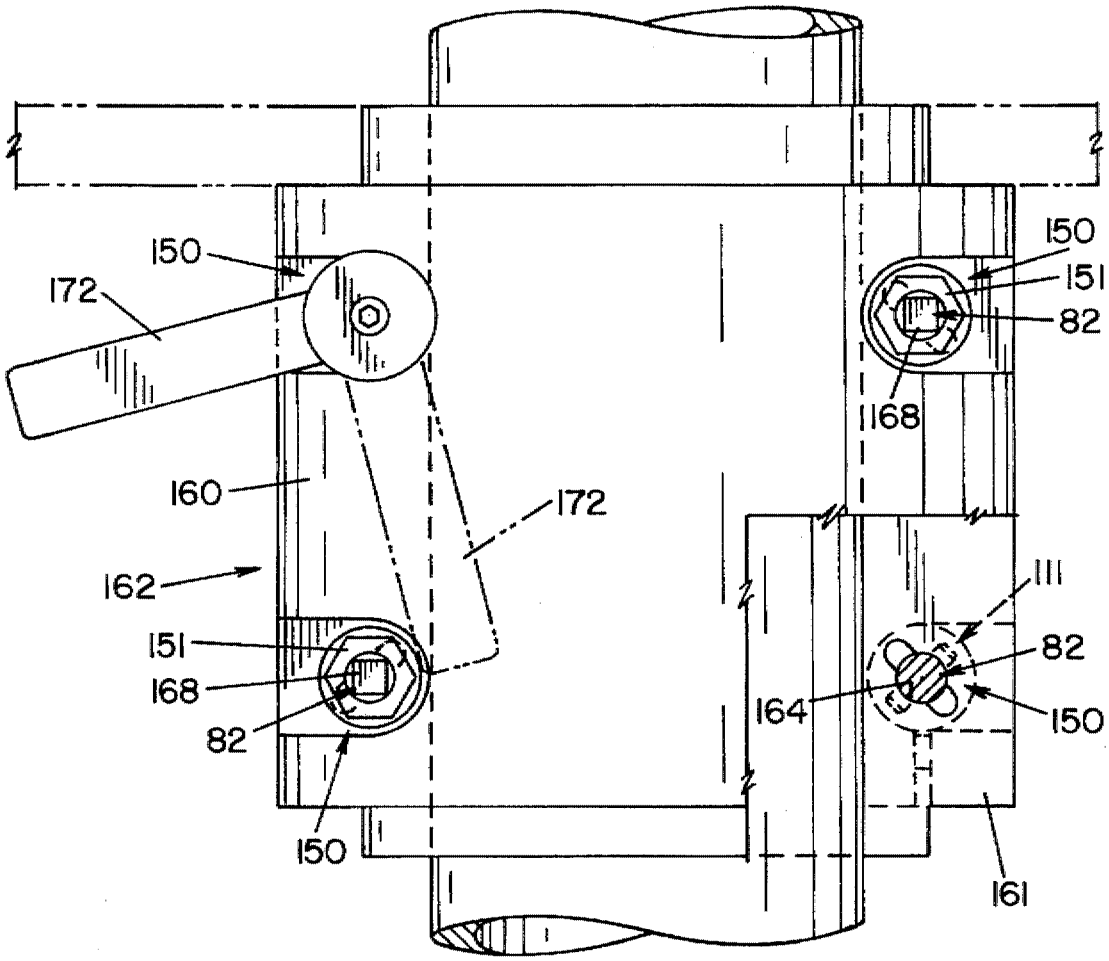
FIG. 12 is an elevation view, partially in cross-section, showing the embodiment of FIG. 11 of the present invention.
Figure 13:
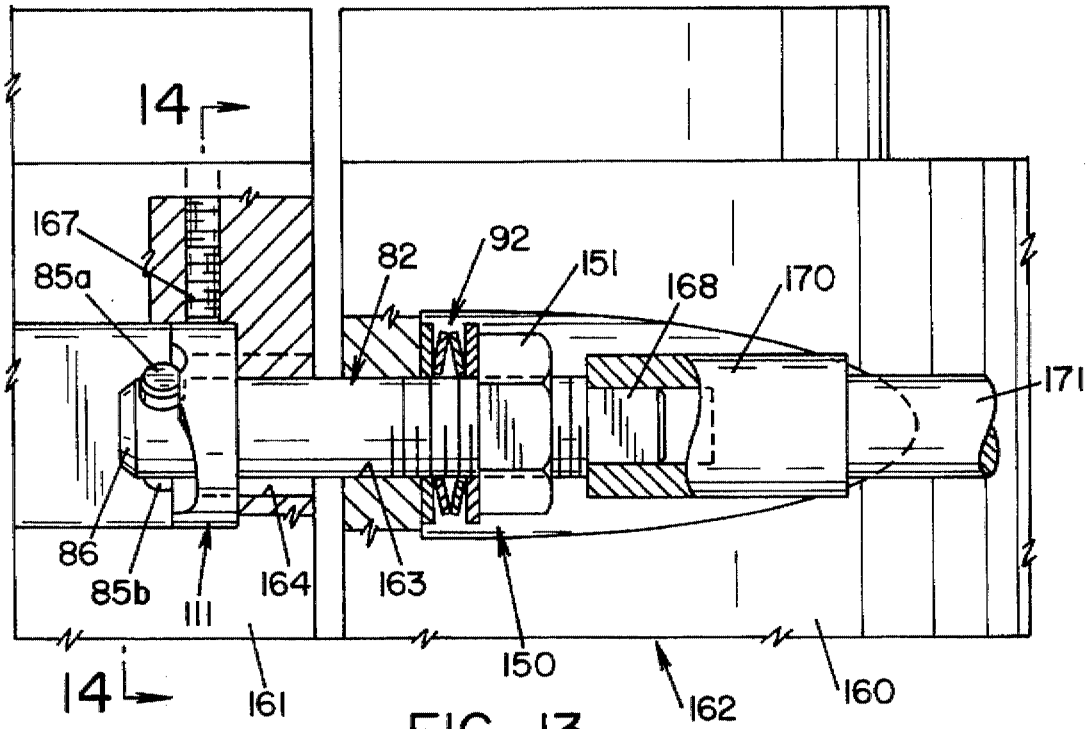
FIG. 13 is an elevation view, partially in cross-section, taken along line 13—13 of FIG. 11.
Figure 14:
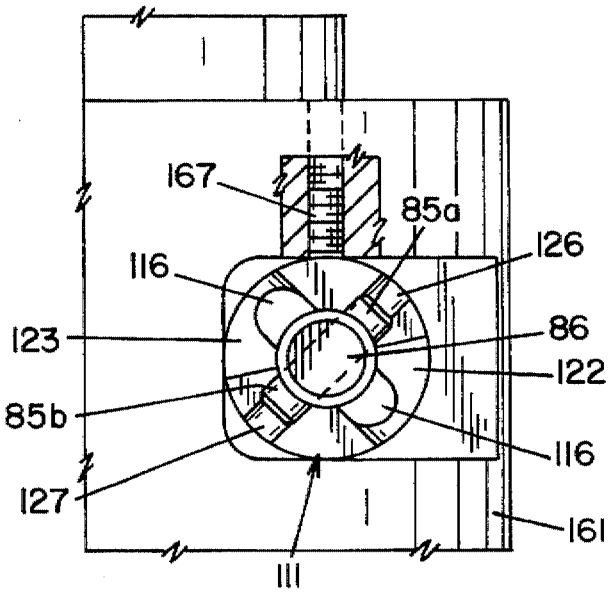
FIG. 14 is an elevation view, partially in cross-section, taken along line 14—14 of FIG. 13.

It will be appreciated that the invention has other applications in a bottling machine. For instance, in the embodiment shown in FIGS. 11–14, a quick connect clamp 150 is shown. Quick connect clamp 150 operates under the same principles as quick connect clamp 81 and common parts are labeled with the same reference numerals. Notably, hex nuts 104 and 105 are replaced with a single nylon lock nut 151. However, the single nylon lock nut 151 performs the same function as hex nuts 104 and 105. In the embodiment of FIGS. 11—14, quick connect clamp 150 is used to attach first and second halves 160 and 161, respectively, of a rotatable star wheel, as is commonly used in a capping machine. As is described elsewhere in this specification, two halves are commonly used where the split hub rotatable star wheel 162 is too large or cumbersome to be manufactured or manipulated as a single unit. As shown, each of the halves are provided with the bored holes 163 and 164 with rod grasping portion 111 held in place by a set screw 167. In contrast to the embodiment of FIGS. 1–10, first end 84 of rod portion 82 is machined to have a square portion 168. A handle or handle portion 83 is eliminated. Instead, a square head socket 170 is used together with an extension 171 and a handle 172 to rotate rod portion 82 from a locked to an unlocked position, as shown in FIG. 12 by the mining 90° of socket handle 172. The socket 170 can thus be removed and used to engage or disengage quick connect clamps 150 from the other portions of split hub 162. The extension 171 allows easy access to quick connect clamp 150 below split hub 162. It will be appreciated that quick connect clamp 150 operates in a like manner to that described above with reference to quick connect clamp 81.

The embodiment of FIGS. 16—19 show quick connect clamp 180 as used on a single star wheel 181 of the type described earlier in this specification. In the original installation to accommodate the invention, original star mountings are removed to gain access to the basic shaft supplied with the bottling machine. A stainless steel hub 182 is mounted directly on the shalt having a shaft access 183. The hub supports a hard-coated aluminum mounting plate 184 that will remain in place for any and all bottles to be run. Stainless steel single star wheel 181 is then mounted to mounting plate 184 using quick connect clamp 180. The guide clamp spacers 185 are mounted using the hex head bolts 186 to provide the proper control height between mounting plate 184 and star wheel 181.

Quick connect clamp 180 will hereafter be described with reference to those elements which are different from previous embodiments. Specifically, a bayonnet spacer 190 is placed over rod portion 82. Essentially, bayonnet spacer 190 is a tubular sleeve having an inner wall 191, a lower outer wall portion 192 and an upper outer wall portion 193, all coaxial about axis A of rod portion 82. Inner wall 91 defines an inner diameter of spacer 190 which is generally equal to or slightly greater than the diameter of rod portion 82. Upper outer wall portion 193 has a smaller outside diameter than does lower outer wall portion 192, thus forming a ring-bearing surface 194. Extending therefrom is upper outer wall portion 193. As assembled, upper outer wall portion 193 extends within a center hole 195 of single star wheel 181, center hole 195 coaxial with shaft axis 183. As such, ring-bearing surface 194 is adjacent to and supports single star wheel 181 at a bottom side 196 thereof. The clamp handle 107 of the embodiment shown in FIGS. 1–10 has been replaced by a plastic knob 197 fitted at the first end 84 of rod portion 82. Knob 197 is held in place by a hex head cap screw 198 bored into first end 84. Nylon lock nut 151 is also used instead of coacting hex nuts 104 and 105. It will be appreciated that other handle designs may also be used, including a socket-type handle, similar to handle 172 of FIG. 11, and fitted to first end 84 in a manner similar to plastic knob 197. A rod gasping portion 201 is made up of two separate portions, a hold down cam 202 and a hold down stud 203. Hold down cam 202 is virtually identical to rod gasping portion 111 and will not be described in further detail. Hold down stud 203 includes a threaded bottom portion 204 which is screwed into a tapped hole 205 within aluminum mounting plate 184, tapped hole 205 coaxial with shaft axis 183. Hold down stud 203 includes a head portion 206 having a bottom bearing surface 207 and a top bearing surface 208 with a cylindrical outer surface 209 extending therebetween. Extending from top bearing surface 208 and within head portion 206 is a pocket opening 211. Pocket opening 211 includes a projection portion 212 and a counterbore portion 214, the counterbore portion extending from top bearing surface 208. Fitted within counterbore portion 214 is hold down cam 202 which is welded therein along the periphery 215 of hold down cam 202 by spot welds 216. It will be appreciated that quick connect clamp 180 functions in a manner identical to that described in previous embodiments. That is, locking projections 85*a*, 85*b* are placed within slotted opening 115 of hold down cam 202 in order that they occupy projection portion 212 of pocket opening 211. A simple 90° twist of knob 197 causes locking projections 85*a* and 85*b* to engage ramp surfaces 122 and 123, respectively whereby spring washers 95 and 96 collapse upon themselves to place tension within rod portion 82 and effectively lock single star wheel 81 to mounting plate 184.

Figure 15:
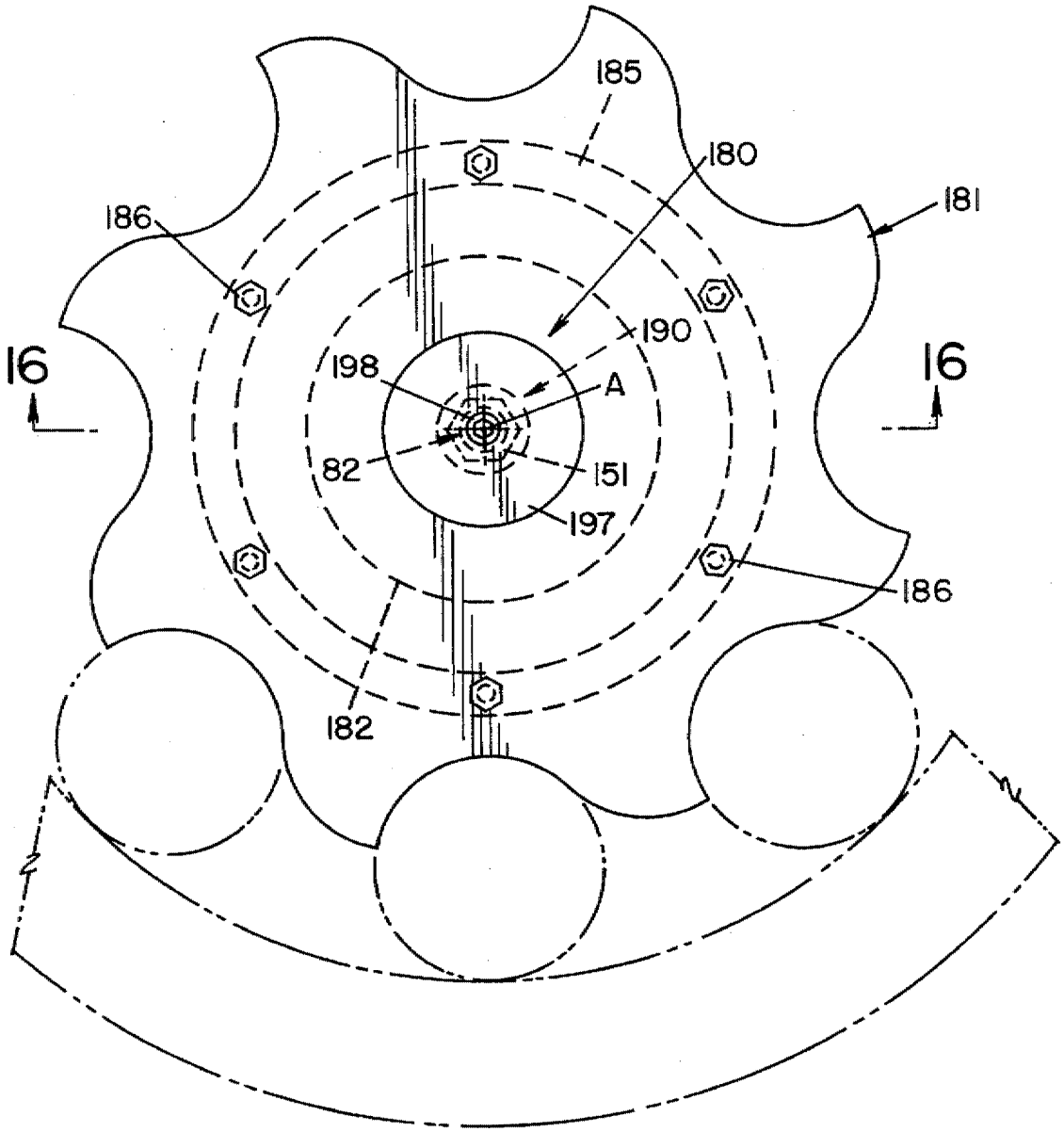
FIG. 15 is a plan view of a star wheel employing a third embodiment of the present invention.
Figure 16:
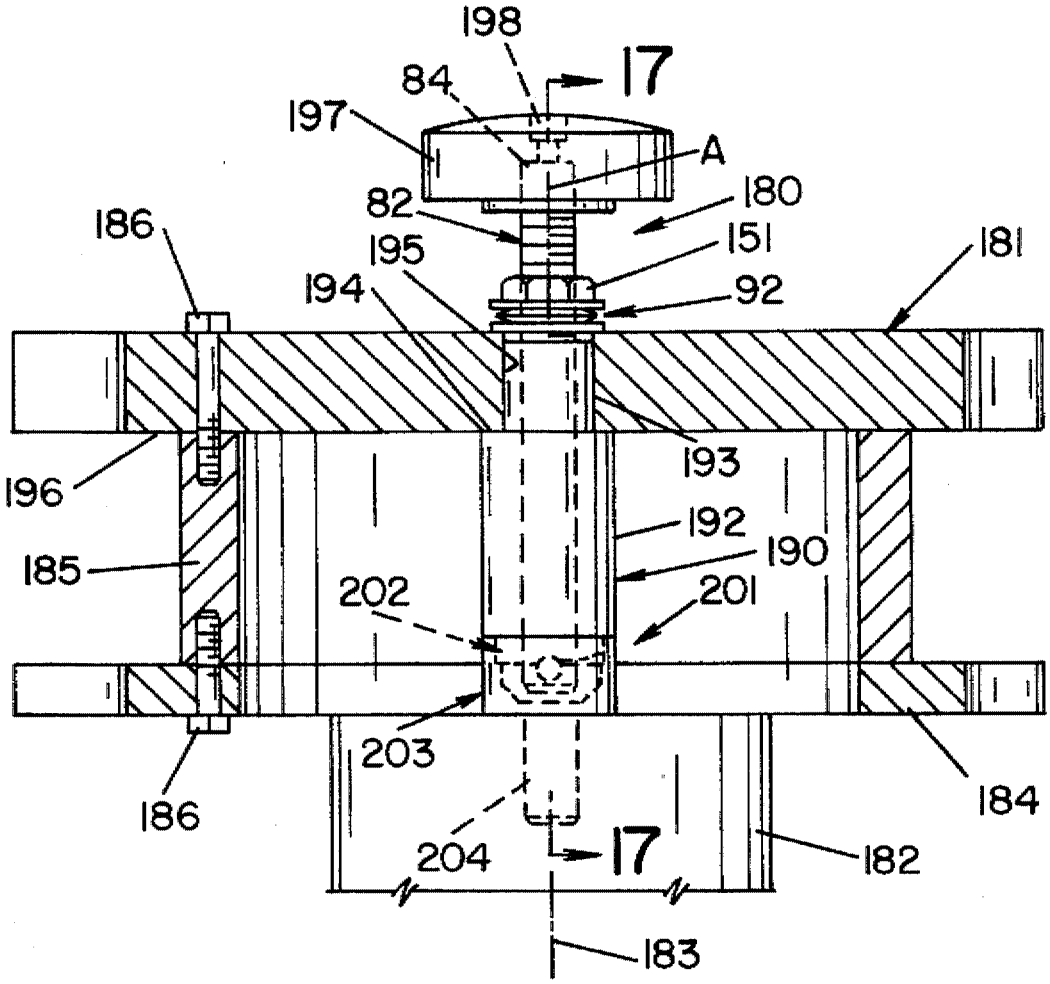
FIG. 16 is an elevation view, partially in cross-section, taken along line 16—16 of FIG. 15.
Figure 17:
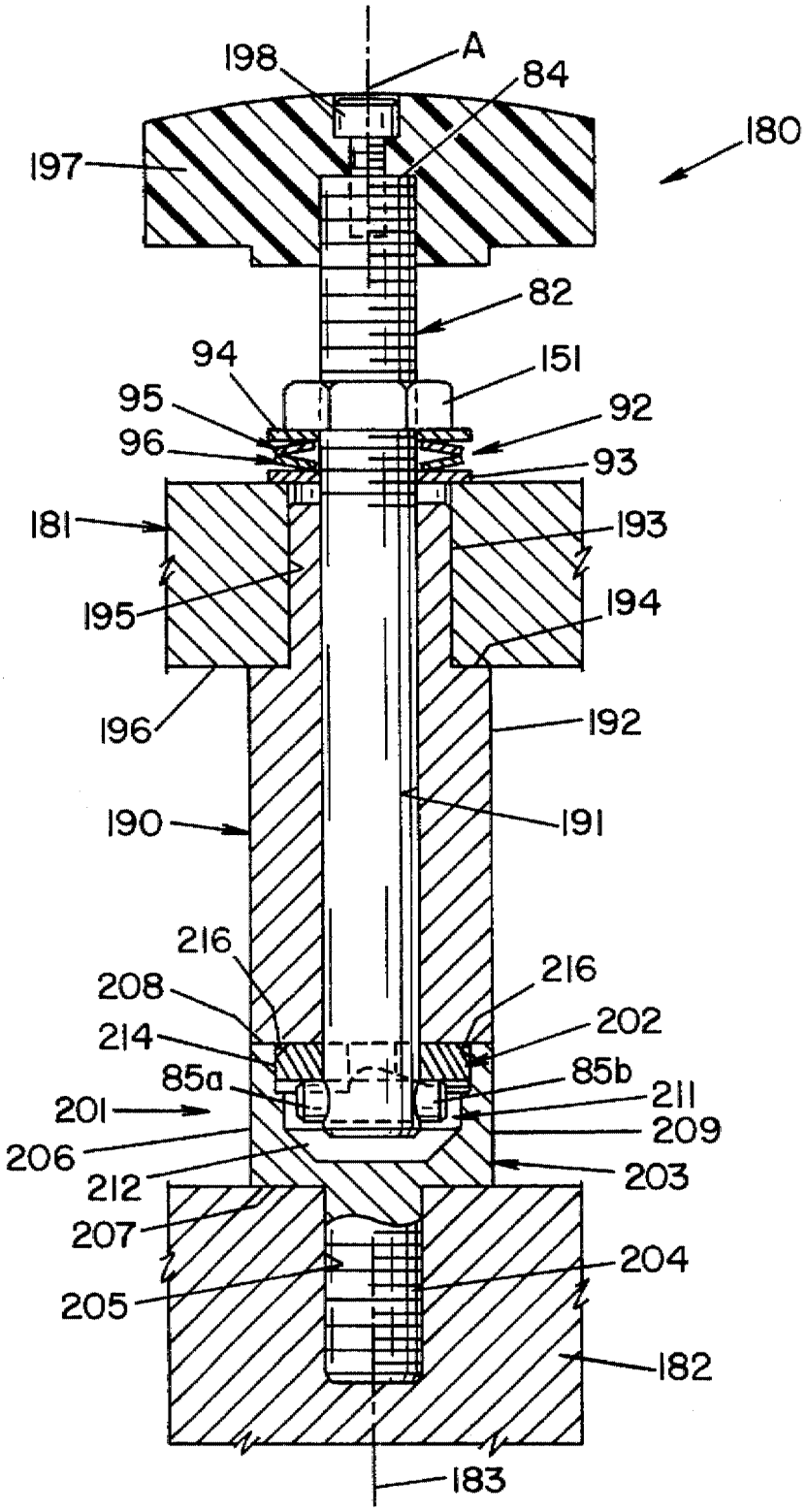
FIG. 17 is a cross-section showing a clamp rod of the third embodiment of the present invention taken along line 17—17 of FIG. 16.
Figure 18:
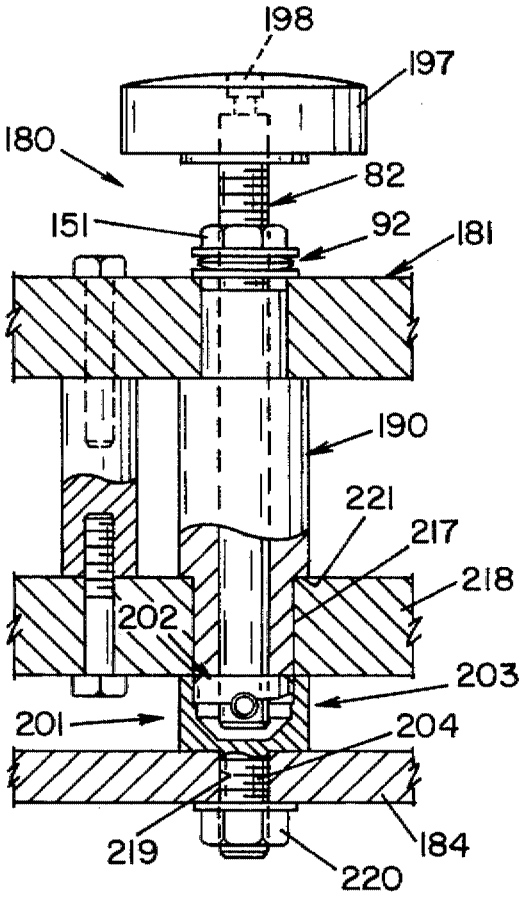
FIG. 18 is an elevation view, partially in cross-section, showing an alternate to the third embodiment of the present invention.
Figure 19:
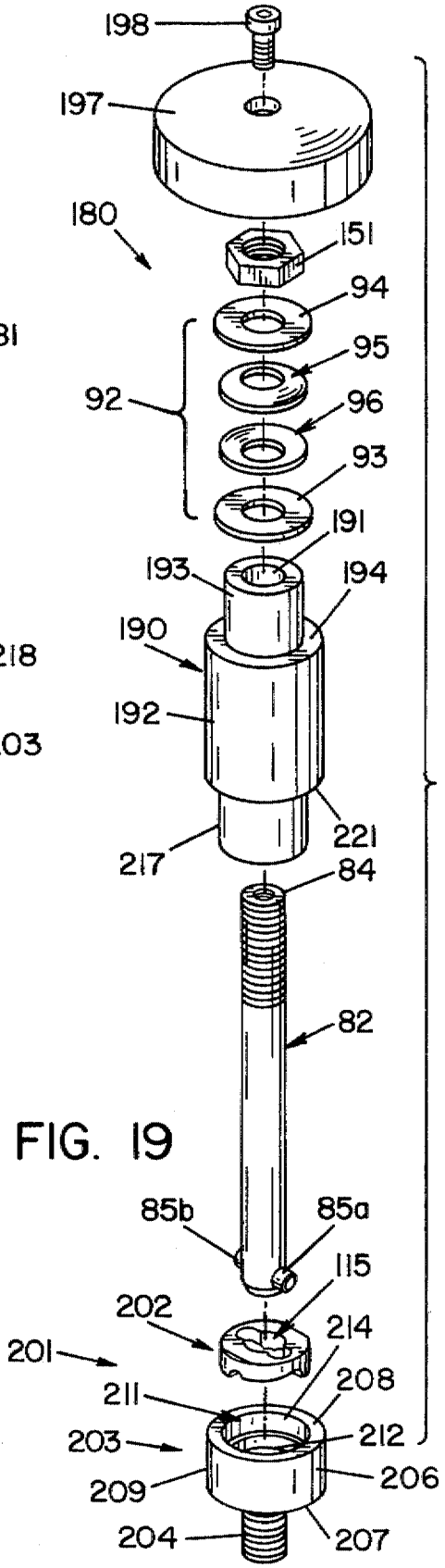
FIG. 19 is an exploded view showing the elements of the third embodiment of FIG. 18 of the present invention.

A slight variation of this third embodiment is shown in FIG. 18 and 19 wherein bayonnet spacer 190 includes a bottom outer wall portion 217 which forms a lower ring bearing surface 221 which bears against a guide 218, mounting plate 184 being spaced therebelow. Threaded bottom portion 204 of hold down stud 203 is placed all the way through a bored hole 219 of mourning plate 184 and is retained thereon by a nut 220. The embodiment of FIGS. 18 and 19 allows a different single star wheel 181 to be mourned to a bottling machine while retaining a control height which is the same as that shown in FIGS. 15–17.

The invention has been described with reference to the preferred embodiments. Obviously modifications and alterations will occur to others upon reading and understanding this specification. It is intended to include all such modifications and alterations insofar as that come within the scope of the invention.

Having thus described the invention, it is claimed:

1. A quick connect clamp for a bottling machine comprising: bayonnet clamp means having a rod portion and complementary rod grasping portion, said rod portion including handle means on a first end for actuating said clamp means, locking means on a second end for inserting within said rod grasping portion and biasing means for actuating said locking means.

2. The clamp of claim 1, wherein said rod portion is a partially threaded stud.

3. The clamp of claim 1, wherein said biasing means is located on said rod portion.

4. The clamp of claim 3, wherein said biasing means includes a compression surface opposite said handle means and spring means therebetween for axially moving said compression surface between a first position and a second position.

5. The clamp of claim 4, wherein said spring means includes a first spring washer and a second spring washer.

6. The clamp of claim 5, wherein each said first and second washer has a frusto-conical shape which includes a small diameter end and a large diameter end, said large diameter ends of each said first and second spring washer adjacent and abutting.

7. The clamp of claim 6, wherein said compression surface includes a first washer adjacent said small diameter of said first spring washer, said biasing means including a second washer adjacent said small diameter of said second spring washer whereby said first and second washers compress said springer washers to actuate said locking means.

8. The clamp of claim 7, wherein said handle means includes an actuator fixedly attached to said rod portion whereby turning said actuator results in turning said rod portion.

9. The clamp of claim 8, including means for adjusting the compression applied to said biasing means.

10. The clamp of claim 9, wherein said means for adjusting includes a lock nut positioned against said second washer.

11. The clamp of claim 9, wherein said means for adjusting includes two complementary nuts positioned on said rod portion in an abutting relationship, one of said two complementary nuts positioned against said second washer.

12. The clamp of claim 1, wherein said locking means includes at least one projection extending from said rod portion.

13. The clamp of claim 1, wherein said locking means includes two projections extending from said rod portion.

14. The clamp of claim 13, wherein said rod portion is cylindrical and includes an axis, said two projections extending from said rod portion at circumferentially opposite locations.

15. The clamp of claim 14, wherein said two projections lie on a common axis, said common axis transverse to said rod portion axis.

16. The clamp of claim 14, wherein said two projections are cylindrical.

17. The clamp of claim 1, wherein said rod grasping portion includes camming means coacting with said locking means to draw down said rod portion.

18. The clamp of claim 17, wherein said rod grasping portion is a cylindrical piece having a first opposite end and a second opposite end, said camming means opposite end and including at least one helical surface thereon.

19. The clamp of claim 18, wherein said cylindrical piece has a central axis and includes an opening therethrough, said opening generally coaxial with said central axis.

20. The clamp of claim 19, wherein said opening is a slotted opening having a circular shape portion transverse to said central axis.

21. The clamp of claim 20, wherein said slotted portions of said opening lie on a common slotted axis transverse to said central axis.

22. The clamp of claim 21, wherein said slotted axis intersects said central axis.

23. The clamp of claim 21, wherein said cylindrical piece includes four quadrants, said first and third quadrants having a helical surface.

24. The clamp of claim 23, wherein said first and third quadrant are opposite each other.

25. The clamp of claim 23, wherein said slotted axis defines a line between said first and said second quadrants as well as between said third and said fourth quadrants.

26. The clamp of claim 23, wherein each said helical surface extends between said slotted axis and a lock axis located generally perpendicular to said slotted axis and transverse to said central axis.

27. The clamp of claim 26, including catch means for releasably retaining said locking means.

28. The clamp of claim 27, wherein said catch means includes two semi-cylindrical slots located on said lock axis.

29. A quick connect clamp for a bottling machine comprising: bayonnet clamp means having a rod portion and complementary rod grasping portion, said portion including handle means on a first end for actuating said clamp means and locking means on a second end for inserting within said rod grasping portion, said rod portion includes biasing means for actuating said locking means, said biasing means including a compression surface opposite said handle means and spring means therebetween for axially moving said compression surface between a first position and a second position, said locking means including two projections extending from said rod portion, said rod grasping portion including camming means coacting with said locking means to draw down said rod portion, said rod grasping portion having a first opposite end and a second opposite end, said camming means located on said first opposite end and including at least one helical surface thereon.

30. The clamp of claim 29, wherein said handle means includes an actuator fixedly attached to said rod portion whereby turning of said actuator results in turning of said rod portion.

31. The clamp of claim 29, including means for adjusting the compression applied to said biasing means.

32. The clamp of claim 31, wherein said means for adjusting includes a lock nut positioned against said biasing means.

33. The clamp of claim 29, wherein said rod portion is cylindrical and includes an axis, said two projections extending from said rod portion at circumferentially opposite locations.

34. The clamp of claim 33, wherein said two projections lie on a common axis, said common axis transverse to said rod portion axis.

35. The clamp of claim 29, wherein said two projections are cylindrical.

36. The clamp of claim 29, wherein said rod grasping portion is a cylindrical piece having a central axis and including an opening therethrough, said opening generally coaxial with said central axis.

37. The clamp of claim 36, wherein said opening is a slotted opening having a circular shape portion transverse to said central axis.

38. The clamp of claim 37, wherein said slotted portions of said opening lie on a common slotted axis transverse to said central axis.

39. The clamp of claim 38, wherein said slotted axis intersects said central axis.

40. The clamp of claim 38, wherein said cylindrical piece includes four quadrants, said first and third quadrants having a helical surface.

41. The clamp of claim 40, wherein said slotted axis defines a line between said first and said second quadrants as well as between said third and said fourth quadrants.

42. The clamp of claim 40, wherein each said helical surface extends between said slotted axis and a lock axis located generally perpendicular to said slotted axis and transverse to said central axis.

43. The clamp of claim 29, including a catch means for releasably retaining said locking means.

44. The clamp of claim 43, wherein said catch means includes two semi-cylindrical slots located on said lock axis.

45. A bottling machine for filling or capping containers having a generally circular cross-section comprising: a rotatable star wheel means having plurality of peripheral individual neck support assemblies for receiving and moving said containers through said machine; each of said plurality of individual neck support assemblies including a pocket support means for holding said containers and a star wheel support portion attached to said star wheel means; said star wheel support portion attached to said pocket support portion by bayonnet clamp means having a rod portion extending through said pocket support means and a complementary rod grasping portion on said star wheel portion, said rod portion including handle means on a first end for actuating said clamp means locking means on a second end for inserting within said rod grasping portion and biasing means for actuating the locking means.

46. A bottling machine for filling or capping containers having a generally circular cross-section section comprising: a rotatable star wheel means mounted on a hub of said bottling machine for moving said containers through said machine; means on said star wheel means for supporting said containers including pocket support means for holding and supporting said containers therein; rear guide means located radially outwardly from said star wheel means for retaining said container within said pocket support means during rotation of the said star wheel means; said rear guide means including sidewall guide means for maintaining the sidewall of said containers in position during rotation of said star wheel means; and means for mounting said star wheel means to said hub including bayonnet clamp means having a rod portion extending through said star wheel means and a complementary rod grasping portion on said hub, said rod portion including handle means on a first end for actuating said clamp means, locking means on a second end for inserting and releasably retaining within said rod grasping portion and biasing means for actuating the locking means.

47. The bottling machine of claim 46, including spacer means for providing a predetermined distance between said hub and said star wheel means.

48. The bottling machine of claim 47, wherein said spacer means includes a sleeve located over said rod portion.

49. The bottling machine of claim 48, wherein said sleeve is cylindrical and extends generally between said handle means and said locking means.

50. A bottling machine for filling or capping containers having a generally circular cross-section comprising: a rotatable star wheel means mounted on a hub of said bottling machine for moving said containers through said machine; means on said star wheel means for supporting said containers including pocket support means for holding and supporting said containers therein; rear guide means located radially outwardly from said star wheel means for retaining said container within said pocket support means during rotation of the said star wheel means; said rear guide means including sidewall guide means for maintaining the sidewall of said containers in position during rotation of said star wheel; said star wheel including a first semi-circular half and a second semi-circular half and means for mounting said halves to said hub including bayonnet clamp means having a rod portion extending through each of said halves and a complementary rod grasping portion on said second half, said rod portion including handle means on a first end for actuating said clamp means, locking means on a second end for inserting and releasably retaining within said rod grasping portion and biasing means for actuating the locking means.

* * * * *